US009783390B2

(12) United States Patent
Valjus

(10) Patent No.: US 9,783,390 B2
(45) Date of Patent: Oct. 10, 2017

(54) ELEVATOR

(71) Applicant: Petteri Valjus, Helsinki (FI)

(72) Inventor: Petteri Valjus, Helsinki (FI)

(73) Assignee: KONE CORPORATION, Helsinki (FI)

( * ) Notice: Subject to any disclaimer, the term of this patent is extended or adjusted under 35 U.S.C. 154(b) by 104 days.

(21) Appl. No.: 14/703,118

(22) Filed: May 4, 2015

(65) Prior Publication Data

US 2015/0344267 A1 Dec. 3, 2015

(30) Foreign Application Priority Data

Jun. 3, 2014 (EP) ..... 14170894

(51) Int. Cl.
*B66B 5/02* (2006.01)
*B66B 9/00* (2006.01)
(Continued)

(52) U.S. Cl.
CPC ..... *B66B 5/02* (2013.01); *B66B 5/0037* (2013.01); *B66B 5/185* (2013.01); *B66B 7/062* (2013.01); *B66B 9/00* (2013.01)

(58) Field of Classification Search
CPC ..... B66B 5/02; B66B 5/0037; B66B 5/185; B66B 7/062; B66B 9/00
(Continued)

(56) References Cited

U.S. PATENT DOCUMENTS 4,145,920 A * 3/1979 Yamagami ..... B66B 7/1223 187/266
4,620,615 A * 11/1986 Morris ..... B66B 15/04 187/264
(Continued)

FOREIGN PATENT DOCUMENTS

DE 102006011093 A1 9/2007
EP 1860055 A1 11/2007
(Continued)

OTHER PUBLICATIONS

European Search Report for EP 14171894 dated Nov. 3, 2014.

*Primary Examiner* — Michael Riegelman
(74) *Attorney, Agent, or Firm* — Harness, Dickey & Pierce, P.L.C.

(57) ABSTRACT

The invention relates to an elevator comprising
a hoistway;
an elevator car vertically movable in the hoistway;
at least one rope connected to the car;
a rotatable traction member comprising a circumferential traction surface for each of the at least one rope;
each of the at least one rope passing around the rotatable traction member and having a front side surface resting against a circumferential traction surface of the traction member, the front side surface and/or the traction surface of the rotatable traction member being made of material comprising polymer; and
a drive machinery for controlling rotation of the rotatable traction member; and
activatable pressing means for pressing the at least one rope against the circumferential traction surface of the traction member which comprise
a pressing shoe mounted on the back side of and out of contact with the rope section of each of said at least one rope, which rope section rests against the rotatable traction member, the pressing shoe being movable towards the back side surface of said rope section; and
actuating means activatable to move the pressing shoe towards the back side surface of said rope section such that the pressing shoe moves into contact with and presses the rope section against the circumferential traction surface of the traction member; and
(Continued)

activating means for activating the actuating means to move the pressing shoe towards the back side surface of said rope section.

20 Claims, 3 Drawing Sheets

(51) Int. Cl.
*B66B 7/06* (2006.01)
*B66B 5/00* (2006.01)
*B66B 5/18* (2006.01)

(58) Field of Classification Search
USPC ..... 187/350
See application file for complete search history.

(56) References Cited

U.S. PATENT DOCUMENTS 5,186,283 A 2/1993 Salmon
5,419,415 A * 5/1995 Lamb ..... B66B 5/0006 116/208
5,651,431 A * 7/1997 Kyrtsos ..... F16D 66/026 188/1.11 L
5,886,308 A * 3/1999 Ericson ..... B66B 7/10 187/391
6,095,289 A * 8/2000 Ray ..... B66B 5/18 188/1.11 E
6,250,430 B1 * 6/2001 Kyrtsos ..... F16D 66/00 188/1.11 L
6,260,665 B1 * 7/2001 Kramer ..... F16D 66/026 188/1.11 E
6,364,062 B1 4/2002 Ericson et al.
7,207,550 B2 * 4/2007 Spiess ..... B66B 11/0476 187/254
2005/0092556 A1 5/2005 Schoppa
2009/0288920 A1 * 11/2009 Kattainen ..... B66B 5/04 187/287
2011/0000746 A1 * 1/2011 Pelto-Huikko ..... B66B 7/062 187/254
2012/0325590 A1 * 12/2012 Valjus ..... B66B 5/04 187/251
2014/0305744 A1 * 10/2014 Kere ..... B66B 7/1238 187/254
2015/0114761 A1 * 4/2015 Helvila ..... B66B 5/125 187/247

FOREIGN PATENT DOCUMENTS

WO WO-0134510 A1 5/2001
WO WO-2009090299 A1 7/2009
WO WO-2013172824 A1 11/2013

* cited by examiner

ELEVATOR

This application claims priority to European Patent Application No. EP14170894.1 filed on Jun. 3, 2014, the entire contents of which are incorporated herein by reference.

FIELD OF THE INVENTION

The invention relates to an elevator. The elevator is particularly meant for transporting passengers and/or goods.

BACKGROUND OF THE INVENTION

An elevator typically comprises an elevator car movable in the hoistway. The elevator further comprises a rotatable traction member, such as a traction wheel, engaging suspension ropes connected to the elevator car. The suspension ropes are typically engaged frictionally by the traction wheel. The suspension ropes pass around the rotatable traction member and suspend at least the elevator car, but usually also a counterweight. For controlling rotation of the rotatable traction member, the elevator comprises a drive machinery, which typically comprises a motor for rotating the rotatable traction member, a control unit for controlling the motor, as well as a brake for braking rotation of said rotatable traction member. Force for moving the car and counterweight is transmitted from the motor to the car via the rotatable traction member and the ropes, whereby movement of the elevator car can be controlled by controlling rotation of the rotatable traction member.

In the event that the car needs to be stopped immediately, a so called emergency stopping is initiated. In the emergency stopping the car is brought into a sudden stop, typically by braking rotation of the traction wheel. A drawback of the known solutions is that an aggressive braking of the traction wheel causes the risk that the engagement between the ropes and the traction wheel is lost. Occurrence of slipping between the ropes and the traction wheel would slow down the progress of the emergency stopping.

Conventionally, elevator ropes are made of steel wires, thereby having a surface made of steel. In prior art, there are also such ropes which have their load bearing member(s) coated with material comprising polymer. By polymer based coating, it is for example possible to adjust, usually aiming to increase, the power transmitting ability over the frictional engagement. The load bearing members can also be protected by the coating. Furthermore, the coating may be used for binding several load bearing members together. In prior art, there are also traction wheels having a traction surface made of material comprising polymer. It has been noted that risk of occurrence of slipping between the ropes and the traction wheel is increased if one or both of the rope and the traction wheel comprises a surface made of material comprising polymer and the temperature of the material comprising polymer rises excessively. In case of high temperature, polymer materials typically melt or at least substantially change their friction properties in temperatures 140-250 degrees centigrade. In case of high temperature, the friction coefficient becomes lower and tensioned rope may start more easily to slide along the traction sheave. This kind of slip with abnormally low friction coefficient has to be prevented during emergency stops, but also in uncontrolled movement situations, i.e. in situations where the car is stopped at a landing with open doors.

BRIEF DESCRIPTION OF THE INVENTION

The object of the invention is, inter alia, to solve previously described drawbacks of known solutions and problems discussed later in the description of the invention. The object of the invention is to introduce an elevator where likelihood of slipping between the ropes and the rotatable traction member of the elevator can be reduced by countermeasures. Safety of the elevator can thus be improved. Embodiments are presented, inter alia, where occurrence of slipping is stopped or even pre-emtied by increasing normal force between the ropes and the rotatable traction member of the elevator selectively in certain conditions or situations. In particular, likelihood of slipping during an emergency stop can be reduced by countermeasures, in particular by activating certain means which can increase traction between the ropes and the rotatable traction member. Safety of the elevator during an emergency stop can thus be improved. Embodiments are presented, inter alia, where predetermined conditions that have be deemed particularly risky with regard to slipping are used for triggering pre-emptive actions.

It is brought forward a new elevator comprising a hoistway; an elevator car vertically movable in the hoistway; at least one rope connected to the car and passing around a rotatable traction member; the rotatable traction member comprising a circumferential traction surface for each of the at least one rope; each of the at least one rope having a front side surface resting against a circumferential traction surface of the traction member. The front side surface and/or the traction surface of the rotatable traction member is made of material comprising polymer. The elevator further comprises a drive machinery for controlling rotation of the rotatable traction member, the drive machinery preferably comprising a motor for rotating the rotatable traction member, and a control unit for controlling the motor, and/or a brake for braking rotation of said rotatable traction member. The elevator further comprises activatable pressing means for pressing, when activated, the at least one rope against the circumferential traction surface of the traction member which activatable pressing means comprise a pressing shoe mounted on the back side of and out of contact with a rope section of each of said at least one rope, which rope section rests against the rotatable traction member. The pressing shoe being mounted to be movable towards the back side surface of said rope section, such that it moves into contact with the back side surface of said rope section and presses the rope section against the circumferential traction surface of the traction member. The elevator further comprises actuating means activatable to move the pressing shoe towards the back side surface of said rope section such that the pressing shoe moves into contact with and presses the rope section against the circumferential traction surface of the traction member; and activating means for activating the actuating means to move the pressing shoe towards the back side surface of said rope section such that the pressing shoe moves into contact with and presses the rope section against the circumferential traction surface of the traction member. Hereby, one or more of the above defined objects are achieved and safety of the elevator is improved. Particularly, in the elevator occurrence of slipping can be stopped or pre-emtied by increasing normal force between the ropes and the rotatable traction member of the elevator by activating the pressing means. Said activating can be performed selectively in certain conditions or situations, for instance.

In a further refined embodiment said activating means comprise at least an electrical safety circuit, breaking of which safety circuit is arranged to cause activation of the actuating means, as well as the drive machinery to stop the rotation of the rotatable traction member, preferably to brake rotation of the traction member with mechanical brake(s)

and/or to stop the motor from rotating the rotatable traction member. Said stopping of the drive machinery is particularly an emergency stopping. The stopping and the activation of the pressing means are in this embodiment caused by one and the same even, i.e. breaking of the safety circuit, whereby it is ensured that during said stopping the means capable of increasing traction are active. Thereby the traction is increased in a situation where reliable slide-free engagement is most needed, i.e. during a stopping, in particular during an emergency stopping sequence of the elevator.

In a further refined embodiment said activatable actuating means comprise an urging means urging the pressing shoe to move towards the back side surface of said rope section; and a holding means for releasably holding the pressing shoe out of contact with the rope section; said holding means being releasable by said activating means to release the urging means to move the pressing shoe towards and into contact with the back side surface of said rope section. Preferably, said urging means comprise one or more springs. Preferably, said holding means comprise one or more solenoids holding the pressing shoe against the force of the urging means out of contact with the rope section when energized (energized only when safety circuit unbroken)

In a further refined embodiment the elevator comprises one or more sensing means arranged to sense one or more elevator condition or parameter and to trigger a series of one or more actions including at least breaking of the safety circuit when said one or more elevator condition or parameter meet(s) one or more predetermined criteria, such as reaches a predetermined limit or changes in a predetermined way. Such sensing means may comprise a temperature sensing means and/or a sensing means for sensing condition of the coating, whereby conditions that are particularly risky with regard to slipping can be used for triggering pre-emptive actions.

In a further refined embodiment said one or more sensing means comprises a temperature sensing means and an increased temperature sensed by the sensing means is arranged to trigger a series of one or more actions including at least breaking of the safety circuit, and thereby to cause the drive machinery to stop the rotation of the rotatable traction member, in particular to brake rotation of the traction member with mechanical brake(s) and/or to stop the motor from rotating the rotatable traction member, and activation of the actuating means. Thus, conditions that are particularly risky with regard to slipping can be used for triggering pre-emptive actions.

In a further refined embodiment said sensing means are arranged to sense temperature of the at least one rope or the temperature of the surroundings of the at least one rope.

In a further refined embodiment the pressing shoe comprises a pressing surface to be pressed against the back side surface of each rope. Each pressing surface faces the back side surface of the section of the rope resting against the rotatable traction member, and each back side surface of the section of the rope resting against the rotatable traction member faces the pressing surface.

In a further refined embodiment said rotatable traction member is a traction wheel and the pressing shoe is mounted movable in radial direction of the traction wheel. Thus, the pressing shoe is movable towards the back side surface of said rope section by moving in radial direction of the traction wheel.

In a further refined embodiment said rotatable traction member is a traction wheel and the pressing surface is arc shaped, the shape of the arc at least substantially extending along arc shaped circumferential traction surface of the traction wheel. Thus, it can have a long contact area with the rope section, whereby traction is considerably improved yet without causing a great friction between the rope section and the pressing surface thereby facilitating sliding contact between them. Preferably, the arc shaped pressing surface extending along the arc shaped circumferential traction surface of the traction wheel covers 30-90 degrees, preferably 45-90 degrees of the traction wheel. Thereby the arc shaped pressing surface has a length substantially corresponding to 1/12-1/4 more preferably 1/8-1/4 of the length of the circumference of the traction wheel. With this kind of structure best results are achieved.

In a further refined embodiment the pressing surface is arranged to press the rope section against the circumferential traction surface of the traction member substantially without moving along with the rope movement during the pressing. Thus, rely on sliding contact between the rope and the pressing shoe. The pressing means are thus simple to manufacture and reliable in use.

In a further refined embodiment the back side surface of the rope and the pressing surface are provided for sliding against each other during the pressing, i.e. when they are in contact and the pressing shoe presses against the back side surface. Thus, the pressing means are simple yet effective in ensuring traction.

In a further refined embodiment the pressing surface is made of low friction material, the material preferably being or at least comprising polytetrafluoroethylene (PTFE), such as Teflon. Thus easy sliding of the pressing surface pressed against the back side surface of the rope section can be facilitated.

In a further refined embodiment the back side surface of the section of the rope resting against the rotatable traction member is smooth in longitudinal direction of the rope, and the pressing surface is smooth in longitudinal direction of the rope against which it is to be pressed. Thus the easy sliding of the pressing surface pressed against the back side surface of the rope section can be facilitated.

In a further refined embodiment each of the at least one rope is in the form of a belt having a front surface made of material comprising polymer. Traction of elevators with belts typically depends strongly on contact properties of the belt and the traction wheel. With the belts having the front surface made of material comprising polymer the surface properties of the belt, which are relevant for traction, are vulnerable to changes. Countermeasures for such changes in his kind of rope can be effectively provided with the pressing means as defined.

In a further refined embodiment the at least one rope comprises several ropes.

In a further refined embodiment each of the at least one rope comprises one or more continuous load bearing members extending in longitudinal direction of the rope throughout the length of the rope. Preferably, the one or more load bearing members are embedded in a common coating made of material comprising polymer and forming the surface of the rope. The coating is preferably made of elastomer, such as polyurethane. The coating provides the rope good wear resistance, protection, and isolates the load bearing members from each other when there are several of those in the rope. The elastic coating also provides the rope high friction, for instance for frictional traction contact with a driven rope wheels. Along with the benefits of the surface material, come drawbacks such as the ones mentioned earlier above.

Such drawbacks typically present in an elevator having this kind of rope can be effectively solved with the pressing means as defined.

In a further refined embodiment, the one or more sensing means comprise a sensing means for sensing condition of the coating wherein the load-bearing part(s) of one or more of said ropes are embedded. Thus, a danger situation can be reacted to simply and effectively. The sensing means are then preferably arranged to sense electric property or properties of a circuit formed at least of one or more of the load bearing members, which are electrically conducting, the coating and a wheel around which the rope(s) being under sensing are arranged to pass. Sensing the condition of the coating extends the usability of the elevator e.g. in situations where there is imminent risk of the coating melting. Such an elevator is a fireman elevator. Sensing the condition of the coating facilitates maintaining the elevator in use for firemen during high temperature conditions such as when the building is on fire until it is necessary to stop the elevator. The sensing means for sensing condition of the coating are preferably arranged to trigger a series of one or more actions including at least breaking of the safety circuit when said electric property or properties meet(s) one or more predetermined criteria, such as reaches a predetermined limit or changes in a predetermined way.

In a further refined embodiment the pressing shoe comprises a pressing surface to be pressed against the back side surface of each rope, each pressing surface facing the back side surface of the rope section which rests against the rotatable traction member. The pressing shoe and the traction member preferably define a gap through which the rope section passes.

Preferably, the pressing surface is a substantially immovable part of the pressing shoe, whereby they move together as one piece during movement of the pressing shoe towards the rope. The pressing shoe preferably comprises a pressing shoe body and the pressing surface is in fixed connection with the pressing shoe body, whereby they move together as one piece during movement of the pressing shoe towards the rope.

The elevator as describe anywhere above is preferably, but not necessarily, installed inside a building. The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
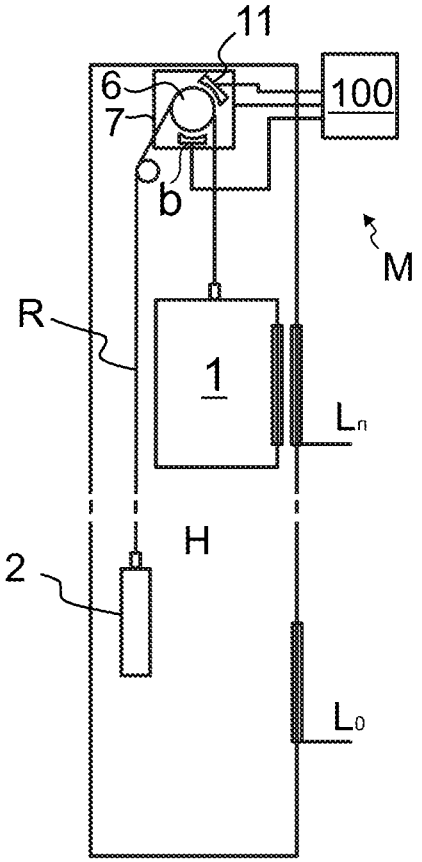
FIG. 1 illustrates schematically an elevator according to a first embodiment of the invention as viewed from the side.

FIG. 1 illustrates an elevator according to a preferred embodiment. The elevator comprises a hoistway H, an elevator car 1 and a counterweight 2 vertically movable in the hoistway H. The elevator car 1 is arranged to serve at least two landings $L_o$ and $L_n$. The elevator further comprises a hoisting roping R comprising at least one rope 3*a*, 3*b*, 3*c* connected to the car 1 and passing around a rotatable traction member 6 comprising a circumferential traction surface 4*a*, 4*b*, 4*c* for each of the at least one rope 3*a*, 3*b*, 3*c*. Each of the at least one ropes 3*a*, 3*b*, 3*c* has a front side surface 5*a*, 5*b*, 5*c* resting against a circumferential traction surface 4*a*, 4*b*, 4*c* of the traction member 6.

The elevator comprises a drive machinery M for controlling rotation of the rotatable traction member 6, the drive machinery M comprising a motor 7 for rotating the rotatable traction member 6, and a control unit 100 for controlling the motor 7, and/or a brake b for braking rotation of said rotatable traction member 6.

The front side surface 5*a*, 5*b*, 5*c* and/or the traction surface 4*a*, 4*b*, 4*c* of the rotatable traction member 6 is made of material comprising polymer, such as elastomer. Therefore, engagement of the ropes 3*a*, 3*b*, 3*c* with the traction member 6 is vulnerable to sliding caused by changes in the surface(s) comprising polymer, in particular to changes in temperature of the surface(s) comprising polymer. The front side surface 5*a*, 5*b*, 5*c* and/or the traction surface 4*a*, 4*b*, 4*c* of the rotatable traction member 6 is made of elastomer such as polyurethane or polyurethane based elastomer. The front side surface 5*a*, 5*b*, 5*c* and/or the traction surface 4*a*, 4*b*, 4*c* of the rotatable traction member 6 is preferably made of elastomer such as polyurethane or polyurethane based elastomer.

Figure 2:
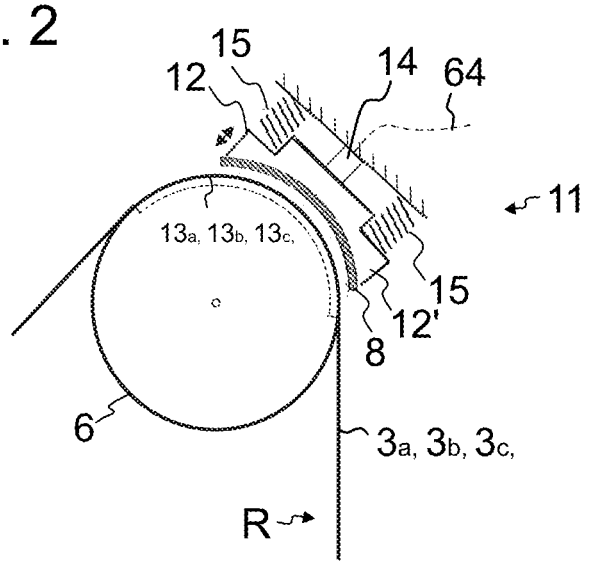
FIG. 2 illustrates schematically the pressing means and the rotatable traction member as viewed from the side.

The elevator further comprises activatable pressing means 11 for pressing, when activated, the at least one rope 3*a*, 3*b*, 3*c* against the circumferential traction surface 4*a*, 4*b*, 4*c* of the traction member 6, which comprise a pressing shoe 12 mounted on the back side of and out of contact with a rope section 13*a*, 13*b*, 13*c* of each of said at least one rope 3*a*, 3*b*, 3*c*, which rope section 13*a*, 13*b*, 13*c* rests against the rotatable traction member 6, the pressing shoe 12 being mounted movable towards the back side surface 9*a*, 9*b*, 9*c* of said rope section 13*a*, 13*b*, 13*c*, such that it moves into contact with the back side surface 9*a*, 9*b*, 9*c* of said rope section 13*a*, 13*b*, 13*c* and presses the rope section 13*a*, 13*b*, 13*c* against the circumferential traction surface 4*a*, 4*b*, 4*c* of the traction member 6. The location of said rope section 13*a*, 13*b*, 13*c* on the traction member 6 is indicated by broken line in FIG. 2. When not activated, the pressing shoe 12 does not contact said rope section 13*a*, 13*b*, 13*c* nor any other parts of the rope 3*a*, 3*b*, 3*c*. Thus, these parts contact only when the pressing means are activated, whereby slight wear or any other damage caused by long-term contact can be avoided. It is possible to activate the pressing means 11 according to needs, e.g. only in special circumstances such as during an emergency stopping as explained elsewhere. Possible drawbacks of the contact, such as slight wear or any other damage, are acceptable during an emergency stopping. The pressing shoe 12 and the traction member 6 define a gap g through which each rope section 13*a*, 13*b*, 13*c* passes. The pressing shoe 12 comprises a pressing surface 8*a*, 8*b*, 8*c* for each rope 3*a*, 3*b*, 3*c* to be pressed against the back side surfaces 9*a*, 9*b*, 9*c* thereof, each pressing surface 8*a*, 8*b*, 8*c* facing the back side surface 9*a*, 9*b*, 9*c* of the rope section 13*a*, 13*b*, 13*c* which rests against the rotatable traction member 6.

The pressing means 11 comprises actuating means 14, 15 activatable to move the pressing shoe 12 towards the back side 9*a*, 9*b*, 9*c* of said rope section 13*a*, 13*b*, 13*c* such that the pressing shoe 12 moves into contact with and presses the rope section 13*a*, 13*b*, 13*c* against the circumferential traction surface 4*a*, 4*b*, 4*c* of the traction member 6. The pressing means 11 further comprise an activating means for activating the actuating means to move the pressing shoe 12 towards the back side surface 9*a*, 9*b*, 9*c* of said rope section 13*a*, 13*b*, 13*c* such that the pressing shoe 12 moves into contact with and presses the rope section 13*a*, 13*b*, 13*c* against the circumferential traction surface 4*a*, 4*b*, 4*c* of the traction member 6.

In the preferred embodiment said activating means may comprise at least an electrical safety circuit 20, breaking of which safety circuit 20 is arranged to cause activation of the actuating means 14, 15. Said breaking of the safety circuit 20 is preferably also arranged to cause the drive machinery M to stop the rotation of the rotatable traction member 6, in particular to brake rotation of the traction member 6 with mechanical brake(s) b and/or to stop the motor 7 from rotating the rotatable traction member 6. Said stopping of the drive machinery is particularly an emergency stopping. Thereby the activation takes place in a situation where reliable slide-free engagement is most needed, i.e. during an emergency stopping sequence of the elevator. A safety circuit is a typically present in all elevators and its structure is regulated by safety norms. It may have structure known in prior art, preferably one following the safety norms. In a preferred embodiment, the safety circuit is in accordance with what is illustrated in FIG. 4.

Figure 4:
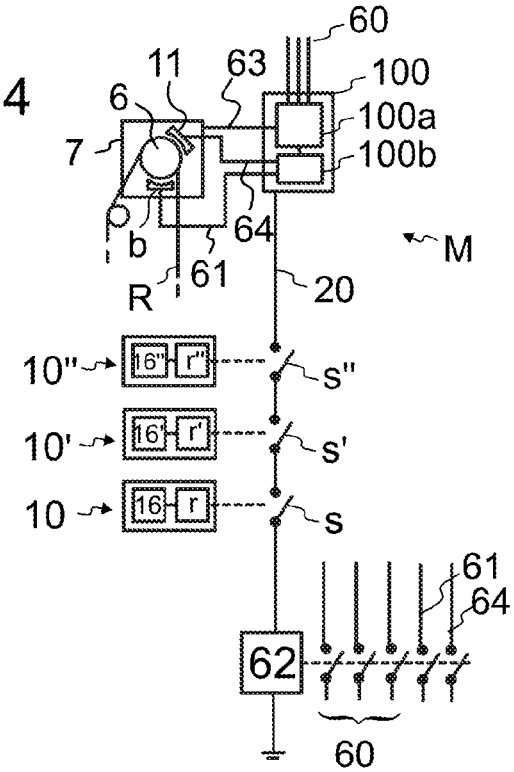
FIG. 4 illustrates schematically a preferred implementation of the activating means for activating the pressing means of FIGS. 1 to 3.

FIG. 4 shows one preferred implementation for the elevator showing also preferred details of the safety circuit 20. In this case, said activating means comprise at least an electrical safety circuit 20 (also known as a safety chain), breaking of which safety circuit 20 is arranged to cause activation of the actuating means 14, 15, as well as the drive machinery M to stop the rotation of the rotatable traction member 6 in particular to brake rotation of the traction member 6 with mechanical brake(s) b and/or to stop the motor 7 from rotating the rotatable traction member 6.

Said activating means comprise one or more sensing means 10, 10', 10' arranged to sense one or more elevator condition or parameter and to trigger a series of one or more actions including at least breaking of the safety circuit 20 when said one or more elevator condition or parameter meet(s) one or more predetermined criteria, such as reaches a predetermined limit or changes in a predetermined way. Thereby, activation of the actuating means, as well as the drive machinery M to stop the rotation of the rotatable traction member 6 is triggered when said one or more elevator condition or parameter sensed by one or more of the one or more sensing means 10, 10', 10' meet(s) one or more predetermined criteria.

For the purpose of breaking the safety circuit 20, each of said one or more sensing means 10, 10', 10" preferably comprise a relay r, r', r" operating a safety switch s, s', s" of the safety circuit 20. The relay r, r', r" is preferably a normally closed-type relay (NC), for instance relay in the form of a SPSTNC-type relay. The sensing means 10, 10', 10" also comprise a sensor 16, 16', 16" arranged to sense the condition or parameter, which the sensing means in question is supposed to monitor, which sensor 16, 16', 16" controls the relay r, r', r". The safety circuit 20 may also be seen to form part of the drive machinery M.

As mentioned, the drive machinery M comprises an elevator control unit 100, This elevator control unit 100 preferably comprises a frequency converter 100*a* and a monitoring unit 100*b* as illustrated in FIG. 4. The monitoring unit may be in the form of a computer comprising one or more microprocessors, for instance. The control unit 100 is preferably connected with electrical connections 61, 63 to the brake(s) b and the motor 7 via which connections it can control the brake(s) b and the motor 7. The control unit 100 is preferably connected with electrical connection 64 to the actuating means 14, 15, in particular to said holding means 14, via which connection 64 it can control the actuating means 14, 15.

In the preferred embodiment according to FIG. 4, the breaking of the safety circuit 20 causes that power supply line 64 of the actuating means 14, 15, in particular the power supply line 64 of the holding means 14, of the pressing means 11 is broken, which holding means 14 hold the pressing shoe 12 against the force of the urging means 15 out of contact with the rope section 13*a*, 13*b*, 13*c* when energized. In this case, the breaking of the safety circuit 20 also causes that power supply line 60 to the frequency converter 100*a* connected to the motor 7 is broken (the power supply 60 being thereby also a power supply of the motor 7) and/or that the power supply line 61 of the actuator(s) of the brake(s) b is broken, which actuator(s) holds(s) the brake(s) b normally in released state when energized. For enabling breaking of the power supply lines 60, 61 and 64, the safety circuit 20 is connected to a contactor 62, which may be in the form of a relay, controlling switches of the power supply lines 60, 61 and 64, as illustrated in the FIG. 4. Preferably, the safety circuit 20 is under voltage and the breaking thereof is arranged to cause the contactor 62 to release said switches to opened state and thereby to break the power supply via these power supply lines 60, 61 and 64.

The actuating means 14, 15 can additionally preferably be controlled via connection 64 by the control unit 100 to activate them also when the safety circuit 20 is unbroken. Thus, control unit 100 can serve as such as an activating means of the actuating means.

The brake(s) b are preferably mechanical brake(s). The brake(s) b is/are preferably arranged to act on the rotatable traction member 6 during the braking by frictional engagement either directly or via any rigid component connected to rotate together with the drive member 6. The brake(s) b is/are preferably so called machine brake(s). The brake(s) b and the motor 7 are preferably both operable by said control unit 100.

In a preferred embodiment, the activating means comprises a sensing means 10 in the form of a temperature sensing means, and an increased temperature sensed by the sensing means is arranged to trigger a series of one or more actions including at least breaking of the safety circuit 20, and thereby to cause the drive machinery M to stop the rotation of the rotatable traction member 6, in particular to brake rotation of the traction member 6 with mechanical brake(s) and/or to stop the motor 7 from rotating the rotatable traction member 6, and activation of the actuating means. Said sensing means 10 are then preferably arranged to sense temperature of the at least one rope 3*a*, 3*b*, 3*c* or the temperature of the surroundings of the at least one rope 3*a*, 3*b*, 3*c*, such as ambient temperature. For the purpose of said sensing, the sensing means 10 comprise a sensor 16 arranged to sense said temperature of the at least one rope 3*a*, 3*b*, 3*c* or the temperature of the surroundings of the at least one rope 3*a*, 3*b*, 3*c*, such as ambient temperature, which sensor 16 controls the relay r operating a safety switch s of the safety circuit 20.

Said activatable actuating means 14, 15 comprise an urging means 15 urging the pressing shoe 12 to move towards the back side surface 9*a*, 9*b*, 9*c* of said rope section 13*a*, 13*b*, 13*c*, and a holding means 14 for releasably holding the pressing shoe 12 out of contact with the rope section 13*a*, 13*b*, 13*c*. Said holding means 14 are releasable by said activating means to release the urging means 15 to move the pressing shoe towards and into contact with the back side surface 9*a*, 9*b*, 9*c* of said rope section 13*a*, 13*b*, 13*c*. In the preferred embodiment, said urging means 15 comprise one or more springs 15, preferably in the form of compression springs. Said holding means 14 comprise one or more solenoids holding the pressing shoe 12 against the force of the urging means 15 out of contact with the rope section 13*a*, 13*b*, 13*c* when energized. Preferably the one or more solenoids 14 are energized only when the safety circuit 20 is unbroken, whereby breaking of the safety circuit 20 is arranged to cause activation of the actuating means 14, 15.

The pressing shoe 12 comprises a pressing surface 8*a*, 8*b*, 8*c* to be pressed against the back side surface 9*a*, 9*b*, 9*c* of the rope. The pressing surface 8*a*, 8*b*, 8*c* faces the back side surface 9*a*, 9*b*, 9*c* of the rope section 13*a*, 13*b*, 13*c* resting against the rotatable traction member 6 and the back side surface 9*a*, 9*b*, 9*c* of the rope section 13*a*, 13*b*, 13*c* resting against the rotatable traction member 6 faces the pressing surface 8*a*, 8*b*, 8*c*.

The pressing surface 8*a*, 8*b*, 8*c* is arranged to press the rope section 13*a*, 13*b*, 13*c* against the circumferential traction surface 4*a*, 4*b*, 4*c* of the traction member 6 substantially without moving along with the rope 3*a*, 3*b*, 3*c* movement during the pressing. For this purpose, the back side surface 9*a*, 9*b*, 9*c* of the rope 3*a*, 3*b*, 3*c* and the pressing surface 8*a*, 8*b*, 8*c* are provided for sliding against each other during the pressing, i.e. when they are in contact and the pressing shoe 12 presses against the back side surface 9*a*, 9*b*, 9*c* of said rope section 13*a*, 13*b*, 13*c*. For this purpose, it is preferable that the pressing surface 8*a*, 8*b*, 8*c* is made of low friction material, preferably polytetrafluoroethylene (PTFE), such as Teflon™. Furthermore, it is preferable that the back side surface 9*a*, 9*b*, 9*c* of the rope 3*a*, 3*b*, 3*c* and the pressing surface 8*a*, 8*b*, 8*c* are provided for contacting each other without shape locking in longitudinal direction of the rope 3*a*, 3*b*, 3*c*. For this purpose, it is preferable that the back side surface 9*a*, 9*b*, 9*c* of the section of the rope section 13*a*, 13*b*, 13*c* resting against the rotatable traction member 6 is smooth in longitudinal direction of the rope 3*a*, 3*b*, 3*c*, and the pressing surface 8*a*, 8*b*, 8*c* is smooth in longitudinal direction of the rope 3*a*, 3*b*, 3*c* against which it is to be pressed.

In the preferred embodiment, said rotatable traction member 6 is a traction wheel and the pressing shoe 12 is mounted movable in radial direction of the traction wheel 6. The pressing shoe is preferably substantially immovable in other directions whereby the pressing shoe, in particular the pressing surface 8*a*, 8*b*, 8*c* thereof can press the rope section against the circumferential traction surface 4*a*, 4*b*, 4*c* of the traction member 6 substantially without moving along with the rope movement during the pressing. The pressing surface 8*a*, 8*b*, 8*c* is a substantially immovable part of the pressing shoe 12, whereby they move together as one piece during movement of the pressing shoe towards the rope. Preferably, the pressing shoe 12 comprises a pressing shoe body 12' movable in radial direction of the traction wheel 6 and the pressing surface is in fixed connection with the pressing shoe body 12', whereby they move together as one piece during movement of the pressing shoe 12 towards the rope.

The pressing surface 8*a*, 8*b*, 8*c* is in the preferred embodiment arc shaped, the shape of the arc at least substantially following arc shaped circumferential traction surface 4*a*, 4*b*, 4*c* of the traction wheel 6. Thus, a strong compression can be produced on the whole length of the rope section 13*a*, 13*b*, 13*c* pressed with the pressing shoe 12. For achieving good results the radius of the arc of the pressing surface 8*a*, 8*b*, 8*c* is preferably the same as that of the traction wheel 6 or slightly larger (0-10% larger).

The pressing shoe 12 and the traction member 6 define a gap g between them of thickness substantially uniform along the length of the gap g (i.e. in longitudinal direction of the rope) through which gap g the rope section passes. This feature is easily achieved with the pressing surface 8*a*, 8*b*, 8*c* being arc shaped, the shape of the arc at least substantially following arc shaped circumferential traction surface 4*a*, 4*b*, 4*c* of the traction wheel 6.

The pressing surface 8*a*, 8*b*, 8*c* is preferably long, covering a large angle of the traction wheel. The arc shaped pressing surface 8*a*, 8*b*, 8*c* extending along the arc shaped circumferential traction surface of the traction wheel covers preferably 30-90 degrees, preferably 45-90 degrees of the traction wheel 6, thereby having a length corresponding to 1/12-1/4 more preferably 1/8-1/4 of the length of the circumference of the traction wheel 6.

Figure 5:
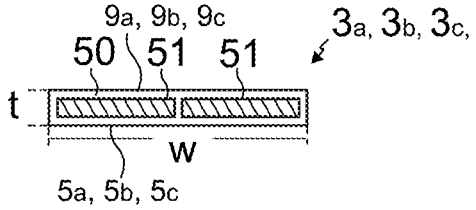
FIG. 5 illustrates a preferred shape and internal structure for the rope.

FIG. 5 illustrates a preferred shape and internal structure for the ropes 3*a*, 3*b*, 3*c*. The rope 3*a*, 3*b*, 3*c* is in the form of a belt, as shown, and has thereby a width w substantially larger than thickness t thereof as viewed in transverse direction of the rope 3*a*, 3*b*, 3*c*. Preferably the width/thickness ratio(s) of the rope is at least 2, preferably at least 4. Thereby, the bending resistance of the rope is small but the load bearing total cross sectional area can be made vast. The rope 3*a*, 3*b*, 3*c* comprises a number of continuous load bearing members 51, in this case two, extending in longitudinal direction of the rope 3*a*, 3*b*, 3*c* throughout the length thereof. The load bearing members 51 are adjacent in width direction of the rope 3*a*, 3*b*, 3*c* and isolated from each other by a common coating 50. The load bearing members 51 are embedded in the common coating 50 made of material comprising polymer and forming the surface of the rope 3*a*, 3*b*, 3*c*, including the front and back side surfaces 5*a*, 5*b*, 5*c*, 9*a*, 9*b*, 9*c*. The coating 50 is preferably made of elastomer, such as polyurethane. The coating 50 provides the rope 3*a*, 3*b*, 3*c* good wear resistance, protection, and isolates the load bearing members 51 from each other, when there are several of those in the rope 3*a*, 3*b*, 3*c*. The coating 50 also provides the rope 3*a*, 3*b*, 3*c* high friction, for instance for frictional traction contact with the rotatable traction member 6.

The one or more sensing means 10, 10', 10" may comprise a sensing means 10' for sensing condition of the coating 50 wherein the load-bearing part(s) of one or more of said ropes are embedded. In this case, each of the at least one rope 3*a*, 3*b*, 3*c* comprises one or more continuous load bearing members extending in longitudinal direction of the rope throughout the length of the rope, the one or more load bearing members 51 being embedded in a common coating 50 made of material comprising polymer and forming the surface of the rope. The sensing means 10' are then preferably arranged to sense electric property or properties of a circuit formed at least of one or more of the load bearing members 51, which are electrically conducting, the coating 50 and a wheel around which the rope(s) being under sensing are arranged to pass. The sensing means 10' are arranged to trigger a series of one or more actions including at least breaking of the safety circuit 20 when said electric property or properties meet(s) one or more predetermined criteria, such as reaches a predetermined limit or changes in a predetermined way. As the electrically insulating coating 50 is wearing off, its insulating capacity is reduced. Finally, the electrically conductive load bearing members inside the rope come into contact with the wheel i.e. short-circuits, and the electric property or properties of the circuit between is/are thereby changed. The sensing means 10' may be more precisely as illustrated and explained WO2009090299 A1 (FIG. 5). The electric property to be sensed may be e.g. electric current flowing through the aforesaid circuit or the resistance or voltage. By sensing the condition of the coating 50 in the above described manner, the danger situation can be reacted to simply and effectively.

Figure 3:
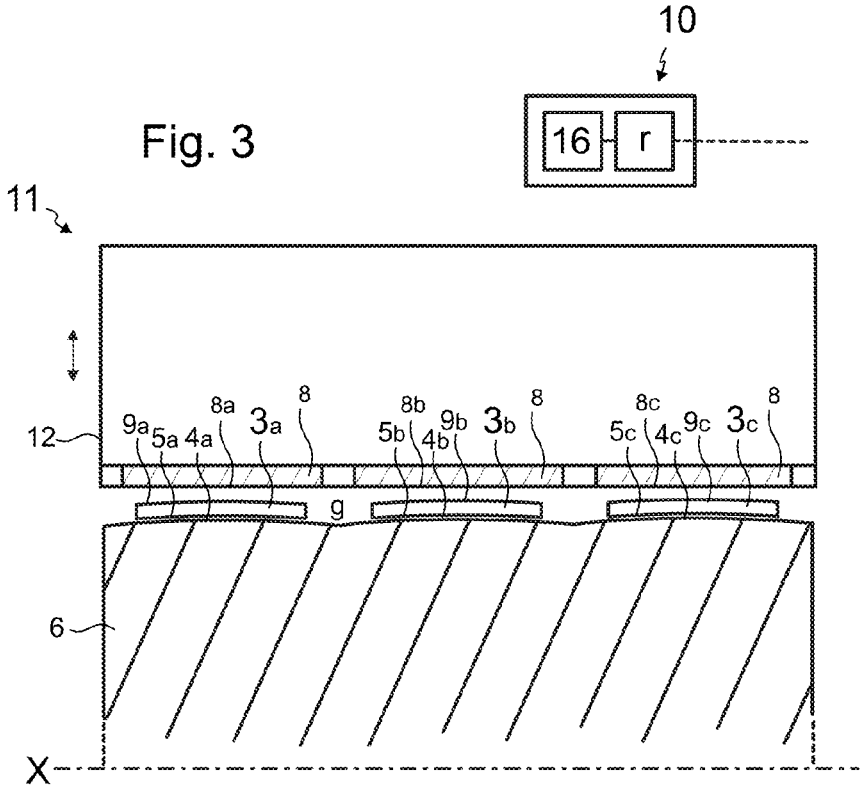
FIG. 3 illustrates schematically a cross-section of the pressing means and the rotatable traction member as viewed in tangential direction of the rotatable traction member. For the sake of clarity internal structure of the rope is not illustrated in this Figure.

As illustrated in FIG. 3, it is preferable that an individual pressing surface 8*a*, 8*b*, 8*c* is provided for each rope 3*a*, 3*b*, 3*c*. FIG. 3 also illustrates that the pressing surfaces 8*a*, 8*b*, 8*c* are surfaces of different surface parts 8. However, this is not necessary, as alternatively one larger surface part 8 could form all the pressing surfaces 8*a*, 8*b*, 8*c* the pressing surface 8*a*, 8*b*, 8*c* thereby being a smaller surface portions of a larger surface.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator comprising:

a hoistway;

an elevator car vertically movable in the hoistway;

at least one rope connected to the car;

a rotatable traction member including a circumferential traction surface corresponding to each of the at least one rope, the at least one rope passing over the rotatable traction member, the at least one rope having a front side surface resting against the circumferential traction surface of the traction member, the front side surface being made of a first material including a polymer;

a drive machinery configured to control rotation of the rotatable traction member; and an activatable pressing device configured to press the at least one rope against the circumferential traction surface of the traction member, the activatable pressing device including, a pressing shoe mounted out of contact with a rope section of each of the at least one rope, the rope section resting against the rotatable traction member, the pressing, shoe configured to move towards and into contact with the rope section, the pressing shoe including a non-rotatable pressing surface that does not rotate when the at least one rope rotates while the non-rotatable pressing surface contacts the rope section, the non-rotatable pressing surface being arc shaped in a direction of rotation of the circumferential traction surface of the rotatable traction member, an actuator configured to selectively move the pressing shoe towards the rope section such that the pressing shoe moves into contact with and presses the rope section against the circumferential traction surface of the rotatable traction member, and an activating device configured to activate the actuator to move the pressing shoe towards the rope section.

2. The elevator of claim 1, wherein the activating device comprises:

at least an electrical safety circuit configured to selectively activate the actuator and the drive machinery to stop a rotation of the rotatable traction member, by braking the rotation of the traction member with at least one mechanical brake and stopping a motor from rotating the rotatable traction member.

3. The elevator of claim 2, wherein the elevator further comprises:

one or more sensors configured to sense one or more of elevator conditions and parameters, and to trigger one or more actions, if the one or more of elevator conditions and parameters meet one or more criteria, the one or more actions including at least breaking the electrical safety circuit.

4. The elevator of claim 3, the one or more sensors comprising:

a temperature sensor, configured to activate the actuator if a sensed temperature reaches a limit temperature.

5. The elevator of claim 4, wherein the temperature sensor is configured to sense a temperature of the at least one rope.

6. The elevator of claim 1, wherein the actuator comprises:

one or more springs configured to urge the pressing shoe to move towards the rope section; and one or more solenoids configured to hold the pressing shoe out of contact with the rope section, the one or more solenoids being releasable by the activating device to release the one or more springs to move the pressing shoe towards and into contact with the rope section.

7. The elevator of claim 1, wherein the rotatable traction member is a traction wheel and the pressing shoe is only movable in a radial direction of the traction wheel.

8. The elevator of claim 1, wherein the rotatable traction member is a traction wheel and the non-rotatable pressing surface is arc shaped, the non-rotatable pressing surface at least substantially extending along the circumferential traction surface of the traction wheel.

9. The elevator of claim 8, wherein the non-rotatable pressing surface is arc shaped such that the non-rotatable pressing surface extends along 30-90 degrees of the traction wheel.

10. The elevator of claim 1, wherein the rope section has a back side surface, the back side surface of the rope section and the non-rotatable pressing surface of the pressing shoe being configured to slide against each other while the pressing shoe presses the rope section.

11. The elevator of claim 10, wherein the back side surface of the rope section and the non-rotatable pressing surface are configured to not shape lock in a longitudinal direction of the rope, if the non-rotatable pressing surface is pressed against the back side surface of the rope section.

12. The elevator of claim 1, wherein the non-rotatable pressing surface is made of a material including polytetrafluoroethylene.

13. The elevator of claim 1, wherein each of the at least one rope is belt-shaped.

14. The elevator of claim 1, wherein each of the at least one rope comprises:

one or more continuous load bearing members extending in a longitudinal direction of a length of a respective one of the at least one rope, the one or more continuous load bearing members being embedded in a common coating made of a third material including a polymer, the common coating forming a surface of each of the at least one rope.

15. A braking system, comprising:

a pressing device including a pressing shoe configured to move towards and into contact with a rope section on a circumferential traction surface of a traction wheel, the pressing shoe including a non-rotatable pressing surface, the non-rotatable pressing surface configured to not rotate when the rope section rotates while the non-rotatable pressing surface contacts the rope section, the non-rotatable pressing surface being arc shaped in a direction of rotation of the circumferential fraction surface of the traction wheel;

mechanical brakes configured to selectively stop movement of the traction wheel; and a controller configured to activate the pressing device and the mechanical brakes.

16. The braking system of claim 15, wherein the pressing device further comprising:

a spring configured to selectively move the pressing shoe towards the rope section such that the pressing shoe moves into contact with and presses the rope section against the traction wheel; and a solenoid configured to selectively hold the pressing shoe out of contact with the rope section based on whether the pressing device is activated.

17. The braking system of claim 15, wherein the non-rotatable pressing surface is arc shaped such that the non-rotatable pressing surface at least substantially extends along 30-90 degrees of the traction wheel.

18. The braking system of claim 15, further comprising:

a temperature sensor configured to sense a temperature of the rope section, and to communicate same to the controller.

19. The braking system of claim 15, wherein the non-rotatable pressing surface is made of a material including polytetrafluoroethylene.

20. A braking system, comprising:

a pressing device including a pressing shoe configured to move towards and into contact with a rope section on a circumferential traction surface of a traction wheel, the pressing shoe including a non-rotatable pressing surface, the non-rotatable pressing surface configured to not rotate when the rope section rotates while the non-rotatable pressing surface contacts the rope section, the non-rotatable pressing surface being made of a material including polytetrafluoroethylene;

mechanical brakes configured to selectively stop movement of the traction wheel; and a controller configured to activate the pressing device and the mechanical brakes.

* * * * *